United States Patent [19]

Euteneuer

[11] 4,415,282

[45] Nov. 15, 1983

[54] SLIDE MOUNT DATA PRINTER

[75] Inventor: Charles L. Euteneuer, St. Michael, Minn.

[73] Assignee: Pako Corporation, Minneapolis, Minn.

[21] Appl. No.: 341,299

[22] Filed: Jan. 21, 1982

[51] Int. Cl.[3] ..... B41F 17/00

[52] U.S. Cl. ..... 400/30; 400/124; 101/35; 101/44

[58] Field of Search ..... 400/126, 124, 654, 656, 400/30, 32, 82; 101/35, 41–44, 235, 232, 233, DIG. 3, 93.04

[56] References Cited

U.S. PATENT DOCUMENTS

| | | | |
|---|---|---|---|
| 2,352,802 | 7/1944 | Ryan et al. | 101/235 |
| 2,547,602 | 4/1951 | Schmitt | 101/44 |
| 3,341,960 | 9/1967 | Florjancic et al. | 40/152 |
| 3,470,642 | 10/1969 | Mundt et al. | 40/152 |
| 3,478,456 | 11/1969 | Mundt et al. | 40/152 |
| 3,524,299 | 8/1970 | Mundt et al. | 53/23 |
| 3,562,074 | 2/1971 | Mundt et al. | 156/580 |
| 3,570,342 | 3/1971 | Mundt | 83/93 |
| 3,614,854 | 10/1971 | Mundt et al. | 53/381 R |
| 3,738,260 | 6/1973 | Navi et al. | 101/35 |
| 3,788,031 | 1/1974 | Florjancic | 53/123 |
| 3,807,121 | 4/1974 | Mundt et al. | 53/23 |
| 3,837,461 | 9/1974 | Waibel | 400/82 X |
| 3,838,250 | 9/1974 | Nass et al. | 235/61.9 |
| 3,867,882 | 2/1975 | Ahlgren et al. | 101/35 |
| 3,910,396 | 10/1975 | Eischen et al. | 400/82 |
| 3,911,813 | 10/1975 | Schaeffer | 101/44 X |
| 3,943,029 | 3/1976 | Mundt et al. | 156/443 |
| 3,977,280 | 8/1976 | Mundt et al. | 83/443 |
| 4,004,340 | 1/1977 | Urban | 29/417 |
| 4,102,029 | 7/1978 | Thompson | 29/417 |
| 4,122,457 | 10/1978 | Erikson et al. | 400/126 X |
| 4,135,343 | 1/1979 | Urban et al. | 53/435 |
| 4,203,679 | 5/1980 | Duerr et al. | 400/320 |
| 4,208,137 | 6/1980 | Liu | 400/124 |
| 4,227,821 | 10/1980 | Plaza et al. | 400/656 X |
| 4,284,362 | 8/1981 | Jackson et al. | 400/124 |

OTHER PUBLICATIONS

Manual of Loersch Corp., *diamount* 2000 *professional.*

Brochure of Loersch Corp. "diamount 2000 professional".

Brochure of Loersch Corp., "quickpoint diatyper".

Brochure of Loersch Corp., "quickpoint supermini".

Brochure of Byers Photo Equipment Co., "Byers Automounter V".

Brochure of Byers Photo Equipment Co., "Byers Date and Numbering Imprinter".

Brochure of Byers Photo Equipment Co., "Byers Dot Matrix Imprinter".

*Primary Examiner*—Clifford D. Crowder

*Attorney, Agent, or Firm*—Kinney, Lange, Braddock, Westman and Fairbairn

[57] ABSTRACT

A data printer prints alphanumeric information on photographic slide mounts. Data printer includes a platform and a pair of parallel guide rails which define a slide track along which slide mounts are advanced. The platform has a printing aperture through which a print head prints alphanumeric characters onto a bottom surface of the slide mount positioned at the printing station. A pair of generally parallel conveyor belts are positioned above the platform and extend along the slide track so that a slide mount at the print station is held between the lower runs of the belt and the platform. An eject motor is actuated when the final slide mount of a customer order has been printed. The eject motor drives the conveyor belt and drives the slide mount out of the printing station and into a slide mount collecting basket. An adjustable platen is also positioned above the slide track over the printing aperture to limit upward deflection of the slide mount during printing on the bottom surfaces of the slide mount.

20 Claims, 9 Drawing Figures

Fig. 1
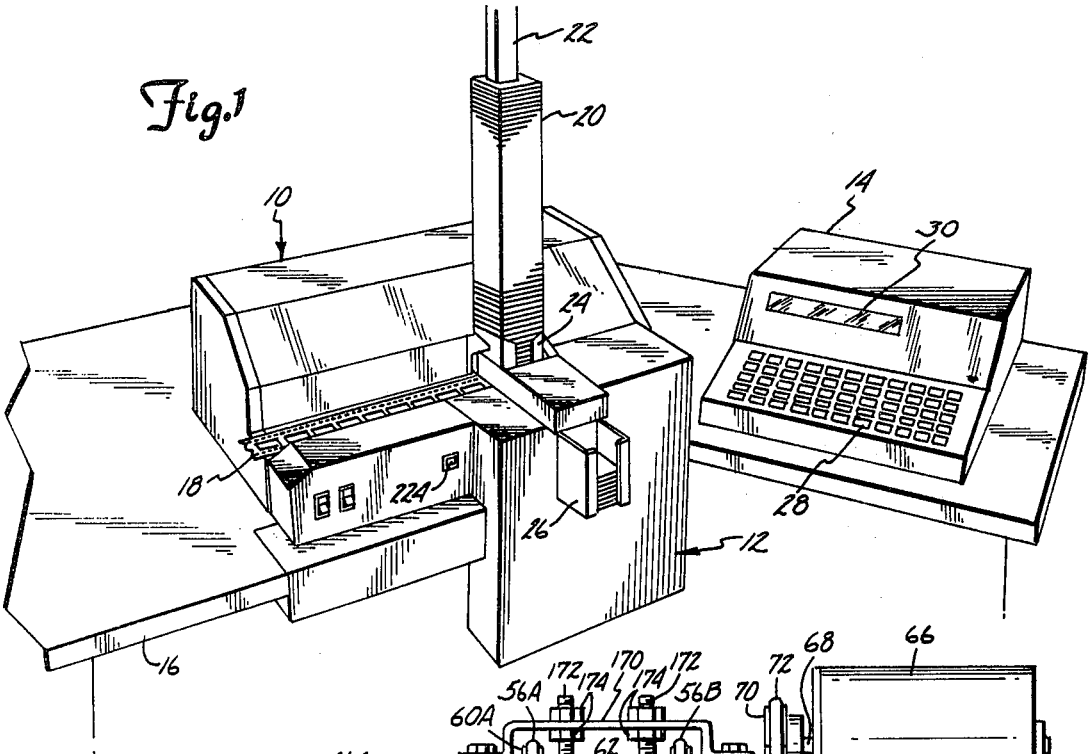
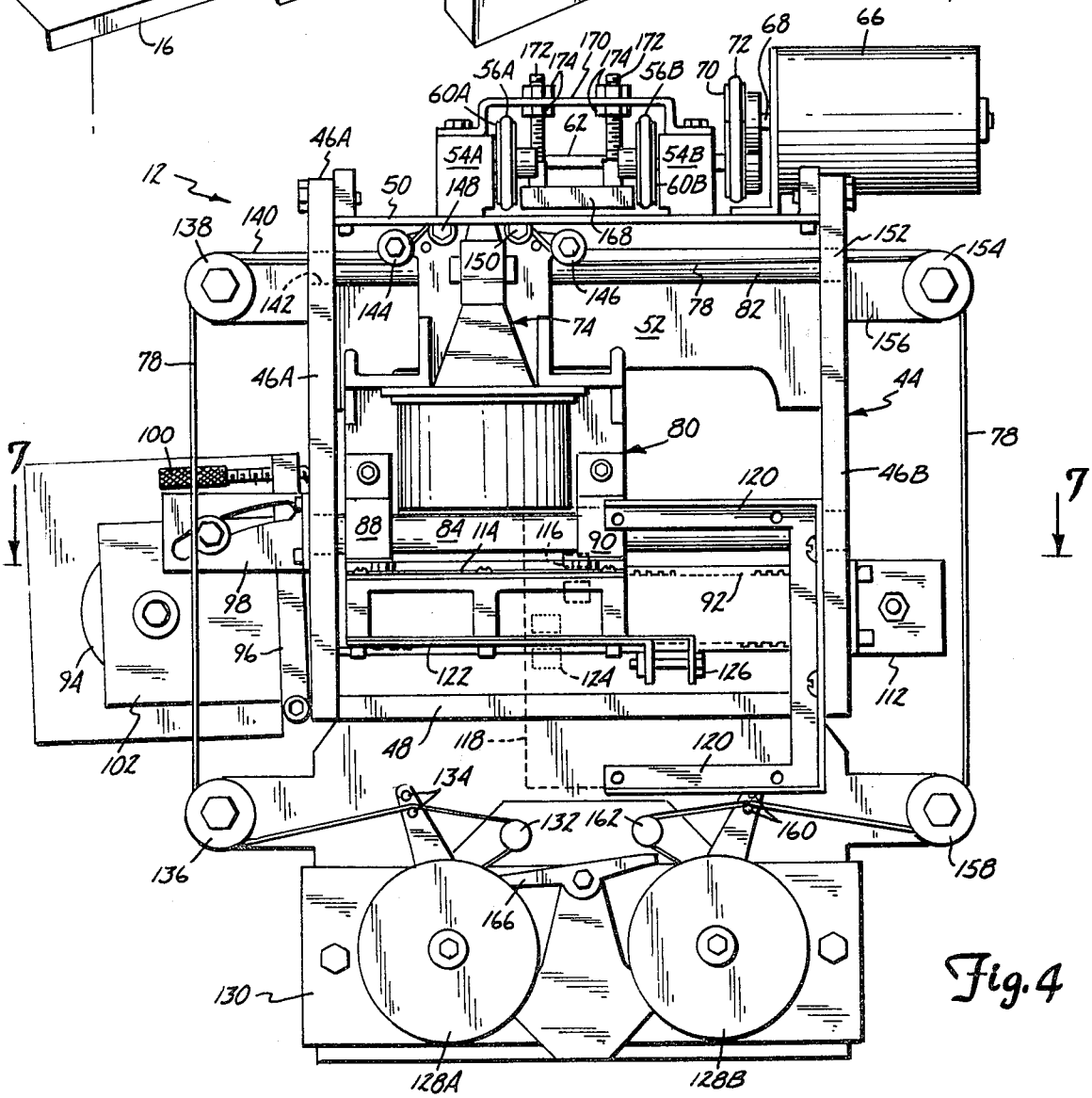
Fig. 4

46B
184
64
72
68
70
186
188
26
41
32
36
54B
58B
56B
62
38
20
58A
56A
60B
60A
54A
42
24
3
3
50
34
34
46A
18

70
66
72
62
56A
58A
24
20
20B
18
6
54A
186
6
41
38
40
20A
40
138
78
10
114
52
182
46A
26
104
108
106
92
98
184
44
96
94
78
178
130
176
164
128A

SLIDE MOUNT DATA PRINTER

CROSS-REFERENCE TO CO-PENDING APPLICATIONS

Cross reference is hereby made to the following application which were filed on even date herewith and are assigned to the same assignee as this application: "Apparatus for Printing Alphanumeric Information on Photographic Slide Mounts", D. Adams and G. Beckman, Ser. No. 341,296, filed Jan. 21, 1982; "Stored Setup Control System for Slide Mount Data Printer", D. Adams, G. Beckman and M. Schultz, Ser. No. 341,290, filed Jan. 21, 1982; "Slide Mount Data Printer with Count Status Indication", G. Beckman and M. Schultz, Ser. No. 341,466, filed Jan. 21, 1982; "Slide Mount Data Printer Control System with Diagnostic Tests", M. Schultz, Ser. No. 341,469, filed Jan. 21, 1982; and "Slide Motion Sensor for Slide Mount Data Printer", R. Simning and M. Schultz, Ser. No. 341,297, filed Jan. 21, 1982.

BACKGROUND OF THE INVENTION

1. Field of the Invention

The present invention relates to photographic slide mounting apparatus. In particular, the present invention relates to apparatus for printing alphanumeric information on photographic slide mounts after a photographic film transparency has been mounted in the slide mount frame.

2. Description of the Prior Art

Photographic slides are produced by mounting a photographic film transparency in a slide mount frame so that the image of the photographic transparency is aligned with the aperture of the frame. A variety of different types of slide mount frames and mounting apparatus have been developed.

One particularly advantageous type of photographic slide mount is the Pakon slide mount, which is a one-piece plastic slide mount sold by Pako Corporation, the assignee of the present application. The Pakon slide mount is a unitary, preclosed mount which requires no folding or sealing after the film is inserted into the mount. Instead, the Pakon slide mount has an insertion slot which may be resiliently expanded by forces applied to the mount by a slide mounting machine to permit insertion of film into a receiving pocket in the mount. After the film has been inserted and cut, the forces applied to the mount are removed, and the spring-like properties of the plastic slide mount allow the mount to return to its original condition, with the insertion slot closed. The slide mount, with the film transparency in the receiving pocket, is then ready for use in a conventional slide projector.

U.S. patents showing slide mounts and slide mounting apparatus of this general type include the following patents:

| | U.S. Pat. No. |
|---|---|
| Florjancic et al | 3,341,960 |
| Mundt et al | 3,470,642 |
| Mundt et al | 3,478,456 |
| Mundt et al | 3,524,299 |
| Mundt et al | 3,562,074 |
| Mundt | 3,570,342 |
| Mundt et al | 3,614,854 |
| Florjancic | 3,788,031 |
| Mundt et al | 3,807,121 |

-continued

| | U.S. Pat. No. |
|---|---|
| Mundt et al | 3,943,029 |
| Mundt et al | 3,977,280 |
| Urban | 4,004,340 |
| Urban et al | 4,135,343 |

The slide mounting apparatus used for mounting transparencies in Pakon slide mounts typically includes a magazine which holds empty slide mounts, a slide track which extends forward from the magazine, and a film track which is perpendicular to the slide track and which intersects the slide track at a film insertion station. The mounting apparatus pushes a lowermost slide mount out of the magazine and into the slide track. The insertion opening of the slide mount faces the film track, so that when the slide mount is aligned at the film insertion station and the insertion opening is resiliently opened, the leading end of the film can be advanced along the slide track into the slide mount through the insertion opening. The film transparency is severed from the end of the film strip and is then inserted the remaining distance into the slide mount, so that the image of the transparency is aligned with the aperture of the slide mount. As the next slide mount is pushed from the magazine into the slide track, it pushes the preceding slide mount from the film insertion station along the slide track toward a collecting basket. As successive mounting cycles of the apparatus occur, the slide mounts are sequentially advanced out of the magazine, along the slide track, and finally to the collecting basket.

In many cases, it is desirable to imprint information on a photographic slide mount after the photographic film transparency has been mounted in the slide mount frame. Numbering imprinters have been developed for use with photographic slide mounting apparatus which imprints numbers sequentially on the slide mounts. The imprinted numbers can be used by the customer to sort the slide mounts into sequential order, since the numbers correspond to the time sequence of the individual frames of the film.

While simply numbering the slide mounts is advantageous, there has been an increasing desire for further information to be printed on the slide mount. This information, which is in alphanumeric form, may include, for example, the customer's name, the photofinisher's name, the name of the scene contained in the slide mount, or the date the slide mount was produced, together with a sequential slide number.

Automatic slide mounting apparatus which includes the capability of printing alphanumeric messages on slide mounts has also been developed. examples of this type of equipment include equipment manufactured by Loersch Corp. and apparatus manufactured by Byers Photo Equipment Company. This equipment includes a slide track for the finished photographic slide (i.e. a slide mount with photographic film transparency mounted therein) which extends away from the station at which the film transparency is mounted. This slide track is generally horizontal and parallel to the film track along which the web of photographic film is advanced. As the finished slide mount is advanced away from the mounting station, it is moved past a stationary print head. Individual letters and numbers are imprinted on the slide mount as it is moved past the print head. The print head is a matrix of individual print elements which strike an ink ribbon to transfer ink onto the slide mount as the slide mount is advancing past the print head.

While the Loersch and Byers imprinters are usable in conjunction with the particular slide mounts and slide mounting apparatus manufactured by those companies, they are not usable with other types of slide mounting apparatus. In particular, there is a need for printing apparatus for use in conjunction with the Pakon slide mounts and slide mounting apparatus. This type of mounting apparatus differs from the other mounts and mounting apparatus in that the Pakon slide mount is preclosed, and is advanced along a slide track which is perpendicular to the film track. There is a continuing need for an improved printing apparatus for use in conjunction with photograhic slide mounting apparatus which is reliable, which provides flexibility in the alphanumeric information to be printed, which is capable of high production rates, which is consistent and compatible with operation of Pakon slide mounter apparatus, and which does not significantly increase the size of the slide mounting apparatus in order to provide the printing functions.

SUMMARY OF THE INVENTION

The present invention is an apparatus for printing alphanumeric information on photographic slide mounts. The apparatus includes a slide track along which photographic slide mounts are advanced. Printer means located at a printing station along the slide track prints alphanumeric characters on a slide mount. Mount indexing means cause slide mounts to index along the slide track from station to station. Slide mount collecting means are positioned adjacent an exit end of the slide track to receive the slide mounts. When the final slide mount of a customer order is at the printing station, switch means provides an eject signal. Eject means responsive to the eject signal drives slide mounts located between the printing station and the eject end of the slide track into the slide mount collecting means.

In a preferred embodiment of the present invention, a numerical count of slide mounts printed is maintained. When the switch means provides the eject signal, the count is reset, so that the apparatus is ready for the start of the next customer order.

The eject means preferably includes a pair of generally parallel conveyor belts which are adjacent the opposite sides of slide track and extend from the printing station toward the exit end of the slide track so that a slide mount located at the print station is held between the conveyor belts and the slide track. The eject means also include eject motor means connected to the conveyor belts for driving the conveyor belts in response to the eject signal. When the conveyor belts are driven, they power drive the slide mounts located between the printing station and the exit end into the slide mount collecting means.

In another preferred embodiment of the present invention, the slide track is defined by a horizontal platform and a pair of horizontal parallel guides attached to the platform. A printing aperture is provided in the platform through which a movable print head prints alphanumeric characters onto a bottom surface of a slide mount positioned at a printing station. Platen means are positioned above the printing aperture at the printing station for engaging a top surface of the slide mount to limit upward deflection of the slide mount when the print head is printing on the bottom surface of the slide mount.

BRIEF DESCRIPTION OF THE DRAWINGS

FIG. 1 is a perspective view showing a slide mounting system including the data printing apparatus of the present invention.

FIG. 4 is a front elevational view of the data printing apparatus of FIGS. 2 and 3.

DETAILED DESCRIPTION OF THE PREFERRED EMBODIMENTS

Figure 2:
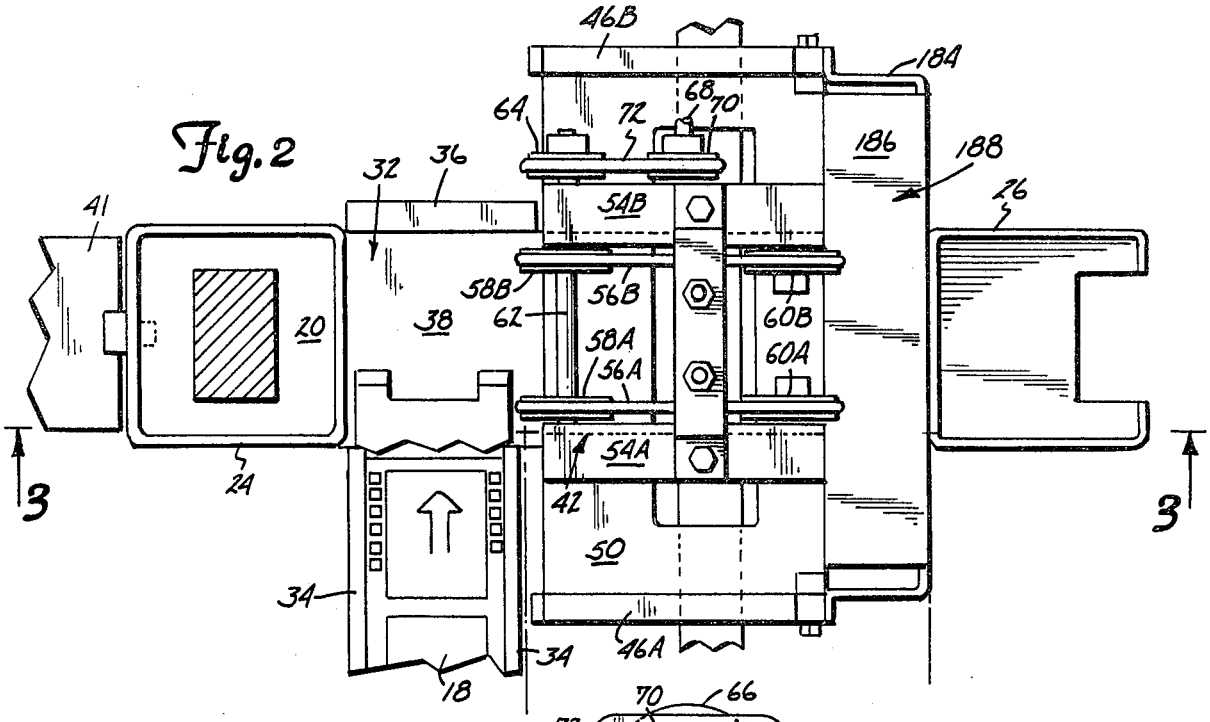
FIG. 2 is a top plan view of the slide mounting and data printing apparatus of FIG. 1, with top cover removed.

1. The Slide Mounting and Data Printing System

FIG. 1 shows a photographic slide mounting system which incorporates the data printing apparatus of the present invention. The system shown in FIG. 1 includes slide mounter 10, data printer 12 and printer control console 14, all of which are supported on table 16. Mounter 10 which is, for example, a Pakon Model 509 mounter, automatically cuts and mounts individual film transparencies from the end of photographic film web 18 in preclosed plastic slide mounts 20, which are supported on arbor 22. During each operating cycle, the lower slide mount 20 in magazine 24 is pushed out of magazine 24 and into a generally horizontal slide track which extends between magazine 24 and collecting basket 26. Film web 18 is advanced along a film track which is generally horizontal and which is perpendicular to the slide track. Slide mount 20 is preferably a preclosed plastic slide mount such as the Pakon slide mount which has an insertion slot adjacent the edge which is closest to the film track. The intersection of the film track and the slide track defines a film insertion station, where the leading end of film web 18 is partially inserted through the insertion opening in slide mount 20. A knife (not shown) severs the transparency from the remaining portion of web 18, the transparency is inserted the remainder of the distance into slide mount 20, and the forces which held the insertion opening open are then removed to allow the slide mount to close.

In the preferred embodiment shown in FIG. 1, data printer 12 is attached to the right front portion of slide mounter 10 between the film insertion stations and collecting basket 26. Data printer 12 extends the slide track to add two stations: a data printing station where alphanumeric information is printed on the bottom side of the slide mount 20, and a holding station where slide mount 20 is held after leaving the data printing station and before being deposited into collecting basket 26.

The alphanumeric information printed on slide mount 20 is based upon control signals which have been entered by the operator through keyboard 28 of control console 14 and which are stored in data memory by the control system of data printer apparatus 12. Keyboard 28 allows the operator to select not only the alphanumeric information to be printed, but also the particular operating mode of data printer 12 which is to be used. Control console 14 also includes display 30, which allows the operator to view the alphanumeric information and to receive prompting messages from the control system.

2. Data Printer Mechanical System

FIGS. 2–7 show the mechanical system of data printer 12 (along with selected portions of slide mounter 10). In the embodiment illustrated in FIGS. 2–7 , the partial insertion, cutting, final insertion of the film and the closing of the slide mount all occurs at a single film insertion station 32. In other slide mounters of this general type, the transparency is partially inserted and cut at the film insertion station, and is inserted the remaining distance into the slide mount frame as it is advanced away from the film insertion station. It will be understood, however, that the data printer of the present invention is usable with either type of slide mounter.

As illustrated in FIG. 2, guide rails 34 of slide mounter 10 define the film track along which film web 18 is advanced. The first portion of the slide track (which corresponds to film insertion station 32) is defined by guide rail 36 and base plate 38 of slide mounter 10.

Figure 3:
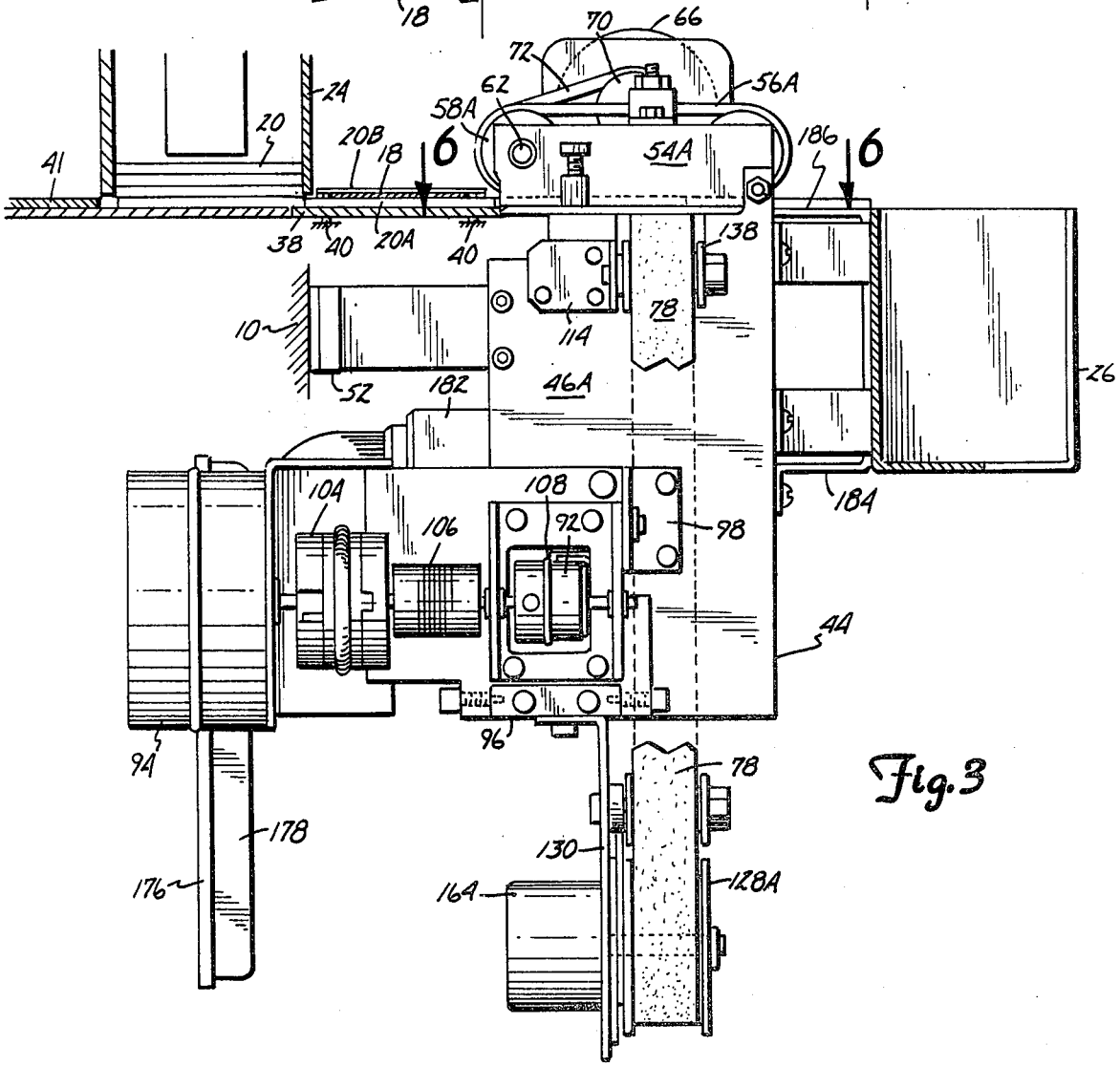
FIG. 3 is a side sectional view along secion 3—3 of FIG. 2.

As best shown in FIG. 3, slide mount 20 has a base 20A and a top cover 20B. A pair of pins 40 are moved upward through holes in base plate 38 and corresponding holes in base 20A to lift top cover 20B to create the insertion opening through which the end of film web 18 is inserted. After cutting and final insertion of the severed end of film web 18 into slide mount 20, pins 40 are retracted to allow cover 20B to return its original position, thus closing the insertion opening.

During the next operating cycle of mounter 10, another empty slide mount frame is pushed by slide pusher 41 out of magazine 24 and along the slide track to insertion station 32. The previous slide mount 20 which was located at film insertion station 32 is pushed by the leading edge of the succeeding mount into data printing station 42 of data printer 12. When slide mount 20 is positioned in printing station 42, alphanumeric characters are printed on the bottom side of base 20A of slide mount 20.

Data printer 12 includes a generally rectangular frame 44 having a pair of vertical side plates 46A and 46B, cross brace 48, and slide track platform 50. Frame 44 is attached directly to slide mounter 10 by rigid mounting bracket 52, which is attached to side plates 46A and 46B.

Platform 50 is generally horizontal, is connected between the upper ends of side plates 46A and 46B, and is coplanar with and abuts base plate 38 of slide mounter 10. Platform 50 and guide blocks 54A and 54B define the extension of the slide track from film insertion station 32 through data printer 12 to collecting basket 26. Guide blocks 54A and 54B have overhanging edges which overhang and guide the longitudinal edges of slide mount 20 as they advance along the slide track through data printer 12.

Slide mount 20 is held securely at printing station 42 between platform 50 and a pair of conveyor belts 56A and 56B. Conveyor belts 56A and 56B are soft, flexible, compressible, high friction elastomeric belts. Belt 56A is trained over pulleys 58A and 60A, while belt 56B is trained over pulleys 58B and 60B. The lower runs of conveyor belts 56A and 56B are positioned parallel to the longitudinal direction of the slide track and engage the longitudinal side surfaces of top cover 20B of slide mount 20 as it is advanced out of film insertion station 32 and into printing station 42. Pulleys 58A and 58B are mounted on a common drive shaft 62 which is journalled through guide blocks 54A and 54B and has a pulley 64 at one end. Eject drive motor 66 has a drive shaft 68 which is connected through pulley 70 and drive belt 72 to pulley 64 and drive shaft 62. Pulleys 60A and 60B are idler pulleys which are rotatably mounted to guide blocks 54A and 54B, respectively. As will be discussed in further detail later, eject motor 66 is actuated at the end of a customer order to drive the slide mounts remaining in data printer 12 out of the slide track and into collecting basket 26. During the normal operating cycles of mounter 10 and data printer 12, eject motor 66 is not actuated, and conveyor belts 56A and 56B are driven solely by friction between the advancing slide mount 20 and belts 56A and 56B.

The second function of eject motor 66 is to detect the motion of slide mount 20 into data printer 12. As slide mount 20 enters data printer 12 from motion of slide pusher 41, and the following mount which is being pushed into film insertion station 32, it is wedged between the platform 50 and the conveyor belts 56A and 56B. The motion causes belts 56A and 56B to turn, which in turn drives DC eject motor 66 causing a DC voltage to be generated. This voltage inputs into the control system of data printer 12, and slide motion is thereby verified. This prevents data printer 12 from printing when no slide mount is present at printing station 42 or from double printing on one slide mount if a misfeed occurs in mounter 10.

The alphanumeric information is printed on the bottom side of base 20A of slide mount 20 by print head assembly 74, which is a ballistic impact head having a plurality of solenoid driven print wires 76 (shown in FIG. 7) which are individually actuated to impact ink ribbon 78. The impact of a print wire 76 with ink ribbon 78 transfers an ink dot onto the bottom surface of slide mount 20. Platform 50 of slide track 26 has an aperture which exposes the bottom surface of slide mount 20 to ink ribbon 78.

In the data printing apparatus 12 of the present invention, the characters being printed on slide mount 20 are oriented in a direction which is transverse to the direction of movement of slide mounts 20 along the slide track. In order to print a line of alphanumeric information without an impractically large print head mechanism, print head assembly 74 is mounted on movable carriage 80. In a preferred embodiment, print head assembly 74 is a ballistic impact head which has nine print pins or print wires 76 (shown in FIG. 6) which are individually driven by hammers (not shown). Each hammer impacts the lower end of one of the print wires 76 when its respective solenoid (not shown) is energized. There is one hammer and one solenoid for each print wire 76, and the hammers and solenoids are arranged in a circular pattern around the lower ends of the print wires.

Movable carriage 80 is movable on a carriage track defined by parallel horizontal shafts 82 and 84. Upper shaft 82 passes through linear bearing 86 (shown in FIGS. 5 and 6) which is attached to the upper end of carriage 80. Lower shaft 84 passes through linear bearings 88 and 90. Bearings 86, 88 and 90 provide support of carriage 80 with low drag during its movement on the carriage track defined by shafts 82 and 84.

Shafts 82 and 84 are supported by side plates 46A and 46B of frame 44. The carriage track defined by shafts 82 and 84 is horizontal, parallel to the plane of the slide track, perpendicular to the longitudinal direction of the slide track, and below the bottom surface of slide mount 20 when it is in printing station 42. Clamp 91 attaches carriage 80 to timing belt 92, which is driven by carriage drive motor 94. In the preferred embodiments shown in FIGS. 2–7, carriage drive motor 94 is a reversible AC synchronous motor which is pivotally mounted through side plate 46A by mounting plate 96 and brackets 98 and 102. A tension adjusting screw 100 is threaded through mounting plate 96 and bears against side plate 46A to adjust the tension on timing belt 92. Carriage drive motor 94 supplies drive to timing belt 92 through clutch assemblies 104 and 106 and pulley 108. The upper run of timing belt 92 is clamped to carriage 80 by clamp 91, so that any movement of timing belt 92 results in movement of carriage 80. The opposite end of timing belt 92 is trained over pulley 110, which is rotatably mounted by bracket 112. As best shown in FIGS. 4–7, bracket 112 is attached to side plate 46B.

Linear encoder 114 is attached to carriage 80 and passes through infrared encoder sensor assembly 116. Encoder pulses produced by encoder sensor assembly 116 signal the control circuitry of data printer 12 as to when printing should occur and where carriage 80 is with respect to the end of travel. When the end of travel has been reached, the motor direction is reversed for the next cycle of printing. Linear encoder 114 and encoder sensor assembly 116 ensure that printing on slide mount 20 is accurately spaced and eliminate variable character width due to speed fluxuations of carriage 80.

Figure 7:
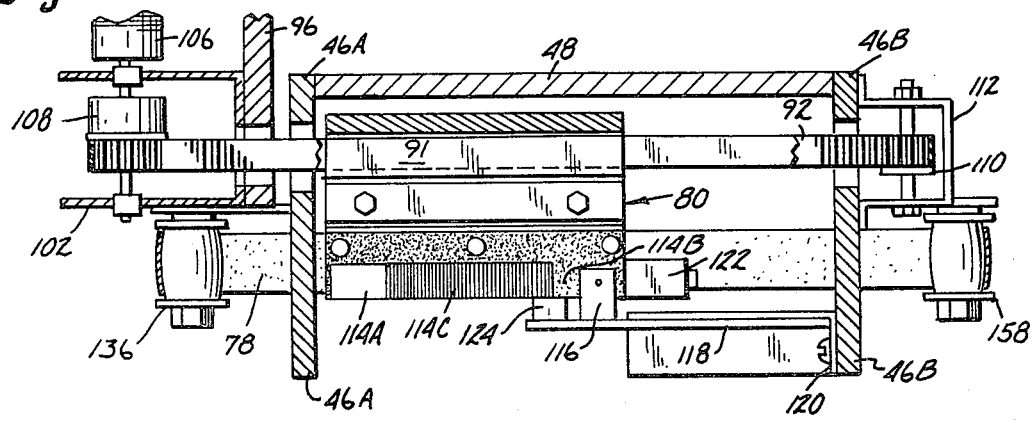
FIG. 7 is a sectional view along section 7—7 of FIG. 4 showing the linear encoder assembly.

As best shown in FIG. 7, linear encoder 114 is preferably a clear plastic sheet having a first end portion 114A which is transparent, a second end portion 114B which is opaque, and an intermediate portion 114C with a plurality of spaced parallel opaque lines. Encoder sensor assembly 116 is mounted on circuit board 118, which in turn is mounted to side plate 46B by mounting bracket 120. Thus sensor assembly 116 is in a fixed position with respect to carriage 80 and linear encoder 114 as carriage 80 is moved on the carriage track defined by shafts 82 and 84. Circuit board 118 carries electrical circuitry (not shown) to energize encoder sensor assembly 116 and to process the encoder pulses. Encoder sensor assembly 116 includes an infrared source such as a light-emitting diode on one side of linear encoder 114, and an infrared sensor such as a photodiode positioned on the opposite side of linear encoder 114. The opaque portions of linear encoder 114 block the infrared beam emitted by the infrared source from reaching the infrared sensor while the transparent portions of the linear encoder 114 permit the beam to reach the infrared sensor. The opaque parallel lines in intermediate portion 114C of linear encoder 114 represent increments of travel of carriage 80 with respect to encoder sensor assembly 116. As carriage 80 moves and the parallel opaque lines pass between the infrared source and infrared sensor of encoder sensor assembly 116, electrical encoder pulses representative of incremental travel of carriage 80 are produced. End portions 114A and 114B allow the control system of data printer 112 to determine whether carriage 80 is located at the left or right end of the carriage track.

In order to prevent damage to print head 74, aperture plate 122 and window sensor assembly 124 are provided. Aperture plate 122 is a metal plate which is mounted to the bottom end of carriage 80 and has an aperture which is shorter than intermediate section 114C of linear encoder 114 and is shorter than the printing opening in platform 50. The aperture defined by aperture plate 122 is used to define the limits between which pin 76 of print head 74 can be actuated. This provides a hardware safety feature which prevents actuation of print head 74 at a position where pin 76 could strike and be damaged by platform 50. Window sensor assembly 124 is mounted on circuit board 118 and is preferably an infrared source/infrared sensor assembly similar to encoder sensor assembly 116. As best illustrated in FIG. 4, the position of the "window" in aperture plate 122 is adjustable by means of adjusting screw 126.

Ribbon 78 extends between a pair of spools 128A and 128B which are rotatably mounted at the bottom of data printer 12 by mounting bracket 130. Ribbon 78 extends over guide 132, between guides 134, 5ver guide roller 136 and upward to and over idler roller 138, which is mounted to side plate 46A by mounting bracket 140. Ribbon 78 then travels in a generally horizontal direction through aperture 142 in side plate 46A to carriage 80.

As best shown in FIG. 4, idler rollers 144 and 146 and guides 148 and 150 are mounted at the upper end of carriage 80 and move with carriage 80 as carriage 80 is driven along the carriage track. Ribbon 78 passes under idler roller 144, over guides 148 and 150 and then under idler roller 146. The portion of the path of ribbon 78 between guides 148 and 150 is horizontal and positioned between print pins 76 in the upper end of portion head 74 and the bottom surface of slide mount 20.

The path of ribbon 78 from idler roller 146 is generally horizontal and passes through aperture 152 in side plate 46B. Ribbon 78 is trained over idler roller 154, which is rotatably mounted by mounting bracket 156 to the outer side of side wall 46B. Ribbon 78 travels downward from idler roller 154 to idler roller 158, between guides 160, over guide 162, and onto spool 128B.

The ribbon mechanism illustrated in FIGS. 2–7 provides automatic direction-of-wind reversal. Ribbon 78 is driven by ribbon drive motor 164 (which is preferably an AC gear motor) through reversible ratchet mechanism 166. Ribbon drive motor 164 is energized during printing cycles of data printer 12.

Positioned on the opposite side of slide mount 20 from ribbon 78 is platen 168, which is a flat metal plate. Slide mount 20 is held securely by guide blocks 54A and 54B, the lower runs of conveyor belts 56A and 56B, and by platen 168 when slide mount 20 is positioned at the printing station. As shown in FIG. 4, platen 168 is supported over the top surface of slide mount 20 and between the conveyor belts 56A and 56B by platen support bracket 170, which extends between the top surfaces of guide blocks 54A and 54B. Platen support bolts 172 and nuts 174 provide adjustability to the vertical position of platen 168. The purpose of platen 168 is to prevent slide mount 20 from deflecting when print wires 76 impact ribbon 78 against the lower surface of slide mount 20.

The density of print is adjusted by positioning density adjust lever 175 (FIG. 5) up or down. Density adjust lever 175 turns eccentric lower traverse shaft 84 such that carriage 80 and print head 74 moves up or down in respect to slide mount 20. By varying the distance between print head 74 and the slide mount 20 various intensities of impact force from print wires 76 can be achieved.

Figure 5:
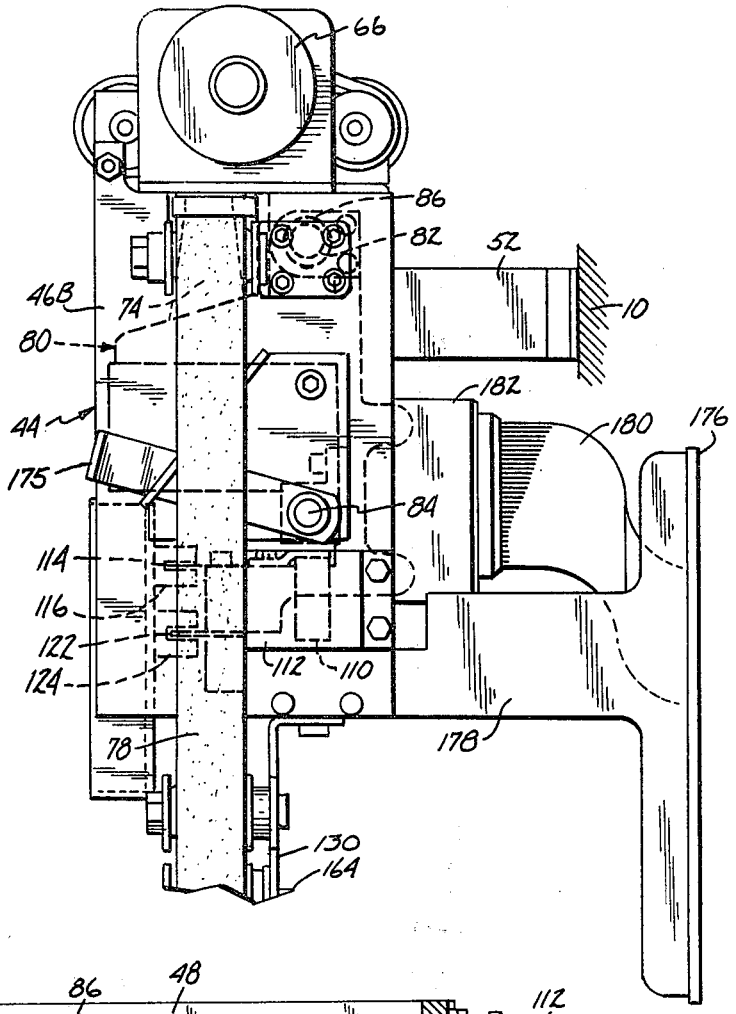
FIG. 5 is a right side elevational view of the data printing apparatus.
Figure 6:
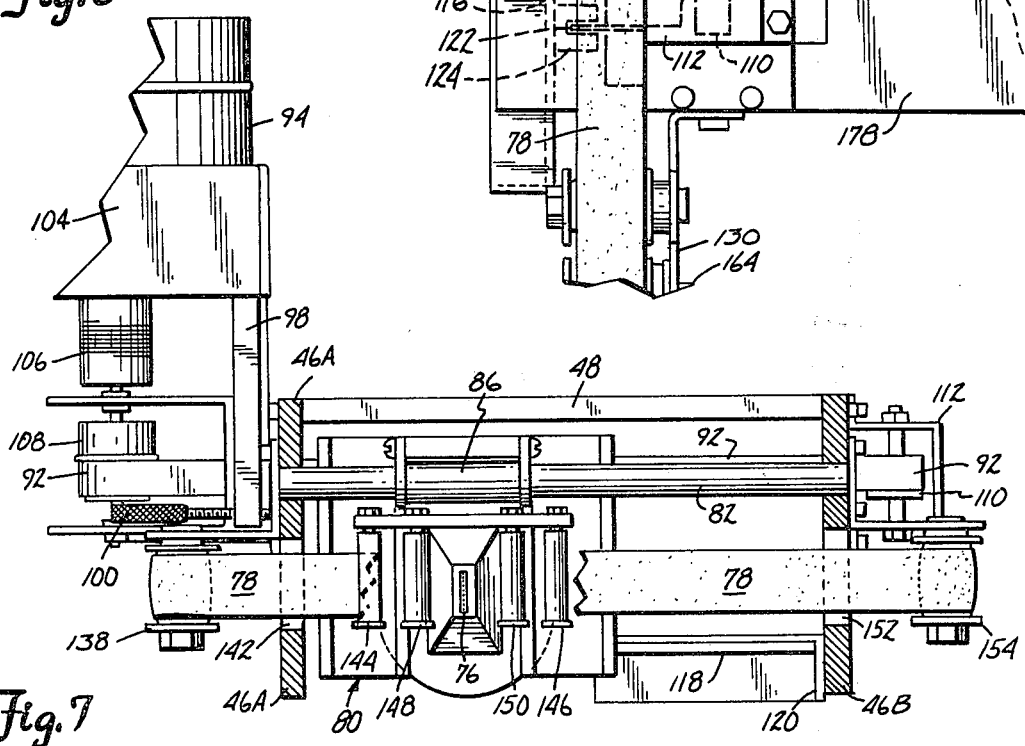
FIG. 6 is a sectional view along section 6—6 of FIG. 3 showing the print head.

The print head solenoid drive circuitry which provides drive signals to the individual solenoids of print head 74 is contained within console 14 and is connected to print head 74 through circuit board 176. As best shown in FIGS. 3 and 5, circuit board 176 is mounted to frame 44 by mounting bracket 178. Electrical connection between circuit board 176 and print head 74 is provided by a flexible flat electrical conductor 180, which has one end connected to circuit board 176 and its opposite end connecteed to electrical connector 182. Electrical connector 182 is mounted on and moves with carriage assembly 80, and thus provides electrical connection to print head 74.

Collecting basket 26 is mounted to frame 44 by mounting bracket 184. Platform extension 186 is coplanar with platform 50 and provides a continuation of the slide track from the printing station 42 to collecting basket 26. The portion of the slide track between printing station 42 and collecting basket 26 defines a slide mount holding station 188. After being pushed out of printing station 42 by the next slide mount to be printed, slide mount 20 is held at holding station 188. During the succeeding cycle, the mount which has just been printed is pushed to slide mount holding station 188, and the slide mount which had been at holding station 188 is pushed into collecting basket 26.

In operation, slide mounter 10 and data printer 12 require four operating cycles to advance slide mount 20 from magazine 24 to collecting basket 26. During the first cycle slide mount 20 is moved to film insertion station 32, where the leading end of film web 18 is inserted, cut and fully inserted into slide mount 20. During the second operating cycle, slide mount 20 is pushed between conveyor belts 56A and 56B and platform 50 into printing station 42. Conveyor belts 56A and 56B maintain the edges of slide mount 20 from loosing contact and overlapping when traveling through data printer 12. In addition, the movement of conveyor belts 56A and 56B due to the advancement of slide mount 20 to the printing station provides motion which is transmitted back to eject drive motor 66. The rotation of drive shaft 68 of eject motor 66 causes eject motor 66 to act as a generator. The generated electric signal produced by eject motor 66 is used as a slide detect signal to the control circuitry of data printer 12. The slide detect signal indicates that a slide mount 20 has been moved into position in printing station 42, and that operation of print head 74 can be initiated. During the second cycle of operation, and after slide mount 20 is stopped at printing station 42, carriage drive motor 94 drives carriage assembly 80 from one end of travel to the other, and the individual solenoids of print head 74 are actuated to produce the desired alphanumeric message on the bottom surface of slide mount 20. Control of print head 74 is based upon stored data which was previously entered by the operator through control console 14, and upon the encoder pulses produced by encoder sensor assembly 116. In preferred embodiments of the present invention, carriage 80 moves from left to right during one cycle, and from right to left during the following cycle. Print head 74 is controlled so that the proper message is printed regardless of which direction carriage 80 is moving during a particular cycle.

During the third operating cycle, slide mount 20 is pushed out of printing station 42 and into holding station 188. During the fourth operating cycle, slide mount 20 is pushed out of holding station 188 and into collecting basket 26.

At the end of each customer order (i.e. when the final slide mount of a customer order is positioned at printing station 42), the operator can signal data printer 12 that the order has been completed. Eject motor 66 is actuated to drive the remaining two slide mounts of the customer order, which are located at printing station 42 and holding station 188 into collecting basket 26. The operator can then remove the entire customer order on slide mounts from collecting basket 26. The first slide mount of the succeeding customer order is left in position at film insertion station 32.

3. Data Printer Electrical Control System

Figure 8:
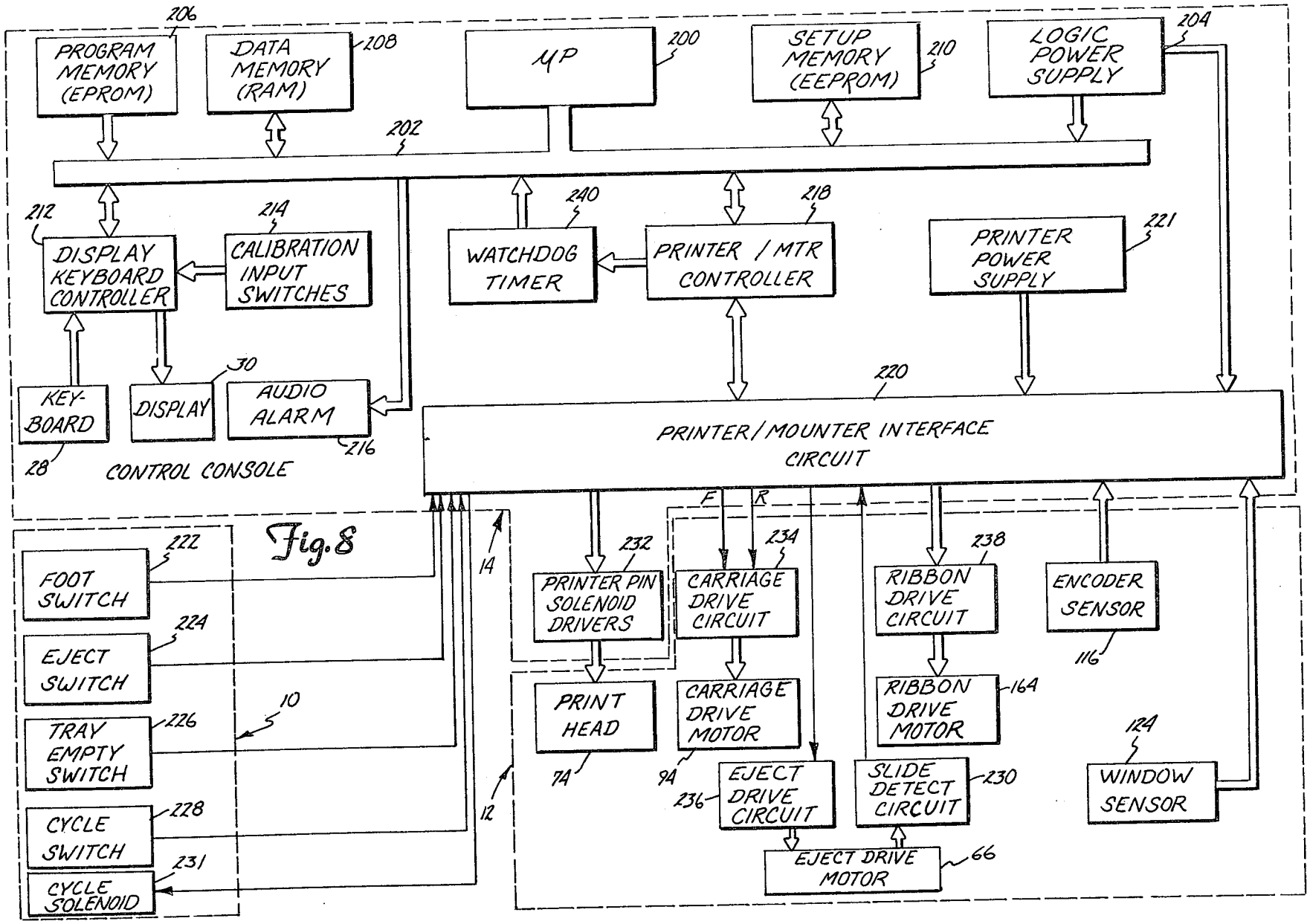
FIG. 8 is an electrical block diagram of the data printing apparatus of the present invention.

FIG. 8 is an electrical block diagram of the control system of the data printing apparatus of the present invention. The control system shown in FIG. 8 includes those assemblies required to drive and control printer 12, to receive inputs from keyboard 28 and provide control signals to display 30 of control console 14, and to receive and provide signals to those portions of slide mounter 10 required to coordinate operation of slide mounter 10 with data printer 12.

The operation of mounter 10, data printer 12, and control console 14 is primarily controlled by microprocessor 200, which is preferably an eight-bit microprocessor. Microprocessor 200 communicates with other portions of the control system through master bus 202, which includes an address bus, a data bus, control lines and power supply lines. Power is supplied to microprocessor 200 and other portions of the digital logic by a logic power supply 204.

Microprocessor 200 controls operation of the control system based upon a stored program contained in program memory 206, which is preferably an erasable programmable read only memory (EPROM). In one preferred embodiment, program memory 206 contains 8K bytes of memory storage. Program memory 206 cannot be altered by microprocessor 200 and is preserved when power is OFF.

Data memory 208 communicates with microprocessor 200 through master bus 202. In the preferred embodiment, data memory 208 contains 512 bytes of random access memory (RAM) provided in two pages. Data memory 208 contains a program stack, display buffers, scratch pad cells, and the current setup being used in controlling operation of print head 74. The data stored by data memory 208 is temporary and can be altered by microprocessor 200. Data memory 208 is erased when power is turned OFF.

Setup memory 210 is a nonvolatile memory which is used to save blocks of setup parameters even when power is OFF. In a prefered embodiment, setup memory 210 includes one or more electrically erasable programmable read only memory (EEPROM) chips. Each chip holds seventy-five blocks of data. Each block of data, which represents one "setup", includes a mode; a text; a low count (for all modes except text only mode); a high count; a duplicate count; and a checksum. The data in setup memory 210 is alterable by microprocessor 200. Setup memory 210 is read by microprocessor 200 just like the other memories 206 and 208.

Each byte of EEPROM setup memory 210 has a life expectancy of ten thousand writes. In order to increase the life of setup memory 210, a defective block of data is automatically written into an alternate block. There are nine such alternate blocks per memory chip. Microprocessor 200 makes a determination of whether the data has been properly written into setup memory 210, and if not then automatically makes the shift to an alternate block. This shift is transparent to the operator, who still addresses the particular setup by means of keyboard 28 using the same setup number.

Microprocessor 200 receives operator control inputs from keyboard 28 and supplies output signals to display 30 of control console 14 through display keyboard controller 212. In addition, calibration input switches 214 provide a binary number through display keyboard controller 212 to microprocessor 200. This binary number tells microprocessor 200 how many encoder pulses to skip before printing the first column in the left-to-right printing mode. This allows printing to be centered on slide mount 20, thus effectively calibrating linear encoder 114. A technician may change the binary number by manipulating calibration input switches 214. In a preferred embodiment, a range of binary numbers are provided which correspond to from 0 to 255 encoder pulses.

Audio alarm 216 is preferably located within control console 14. Microprocessor 200 actuates audio alarm 216 for a 100 msec duration by addressing audio alarm 216 through master bus 202.

Microprocessor 200 receives input signals from mounter 10 and data printer 12 and supplies output and control signals to mounter 10 and data printer 12 through printer/mounter controller 218 and printer/-mounter interface circuit 220. Printer power supply 221 supplies the neccessary voltages for printer/mounter interface circuit 220, print head 74, and window sensor 124.

In FIG. 8, only those portions of slide mounter 10 which provide signals to interface circuit 220 or receive signals from interface circuit 220 are shown. Foot switch 222 and eject switch 224 are operator control switches associated with slide mounter 10. Foot switch 222 is depressed by the operator in order to commence and continue operation of slide mounter 10. When foot switch 222 is released, operation of slide mounter 10 is halted. Eject switch 224 is a pushbutton switch which, when actuated, results in eject drive motor 66 being actuated to drive the final two slide mounts out of the slide track and into collecting basket 26. Eject switch 224 performs the same function as the EJECT/RESET key on keyboard 28. In addition to causing eject drive motor 66 to operate, depressing eject switch 224 also causes microprocessor 200 to reset the count if printer 12 is being operated in a slide numbering mode.

Other inputs from slide mounter 10 to printer/-mounter interface circuit 220 include tray empty switch 226 and cycle switch 228. Tray empty switch 226 indicates that magazine 24 has run out of slide mounts. Cycle switch 228 provides a signal which indicates that mounter 10 has just completed a mounting cycle. This signal is used to coordinate operation of data printer 12 with slide mounter 10.

Inputs to interface circuit 220 from data printer 12 include encoder sensor 116, window sensor 124, and slide detect circuit 230. As shown in FIG. 8, slide detect circuit 230 is connected to eject drive motor 66, and produces a signal when eject drive motor 66 produces a voltage output. This occurs when a slide mount is being pushed out of film insertion station 32 and into printing station 42. In that case, eject drive motor 66 is being operated as a generator rather than a motor. The eject drive motor 66, therefore, performs a dual function in data printer 12.

The outputs of microprocessor 200 which are supplied through controller 218 and interface circuit 220 are supplied to cycle solenoid 231 of mounter 10, and to printer pin solenoid drivers 232, carriage drive circuit 234, eject drive circuit 236, and ribbon drive circuit 238 of data printer 12. The output to cycle solenoid 231 initiates an operating cycle of mounter 10.

Printer pin solenoid drivers 232 supply drive pulses to the solenoids (not shown) of print head 74 in order to actuate the individual print pins (print wires 76) of the nine-pin array of print head 74. Solenoid drivers 232 are activated by microprocessor 200 through interface circuit 220 for 340 microseconds, as timed by a software loop.

Carriage drive circuit 234 accepts either a forward (F) or a reverse (R) signal from interface circuit 220. When the forward signal is provided, carriage drive circuit 234 causes carriage drive motor 94 to drive carriage 80 from left to right. Similarly, when the reverse signal is received, carriage drive circuit 234 causes carriage drive motor 94 to drive carriage 80 from right to left.

A signal from interface circuit 220 to eject drive circuit 236 turns on eject drive motor 66. Similarly, a signal from interface circuit 220 to ribbon drive circuit 238 turns on ribbon drive motor 164.

As shown in FIG. 8, the control system also includes watchdog timer 240. Microprocessor 200 sets watchdog timer 240 by a signal supplied through printer/mounter controller 218. The output of watchdog timer 240 is a system reset which is supplied to master bus 202.

Figure 9:
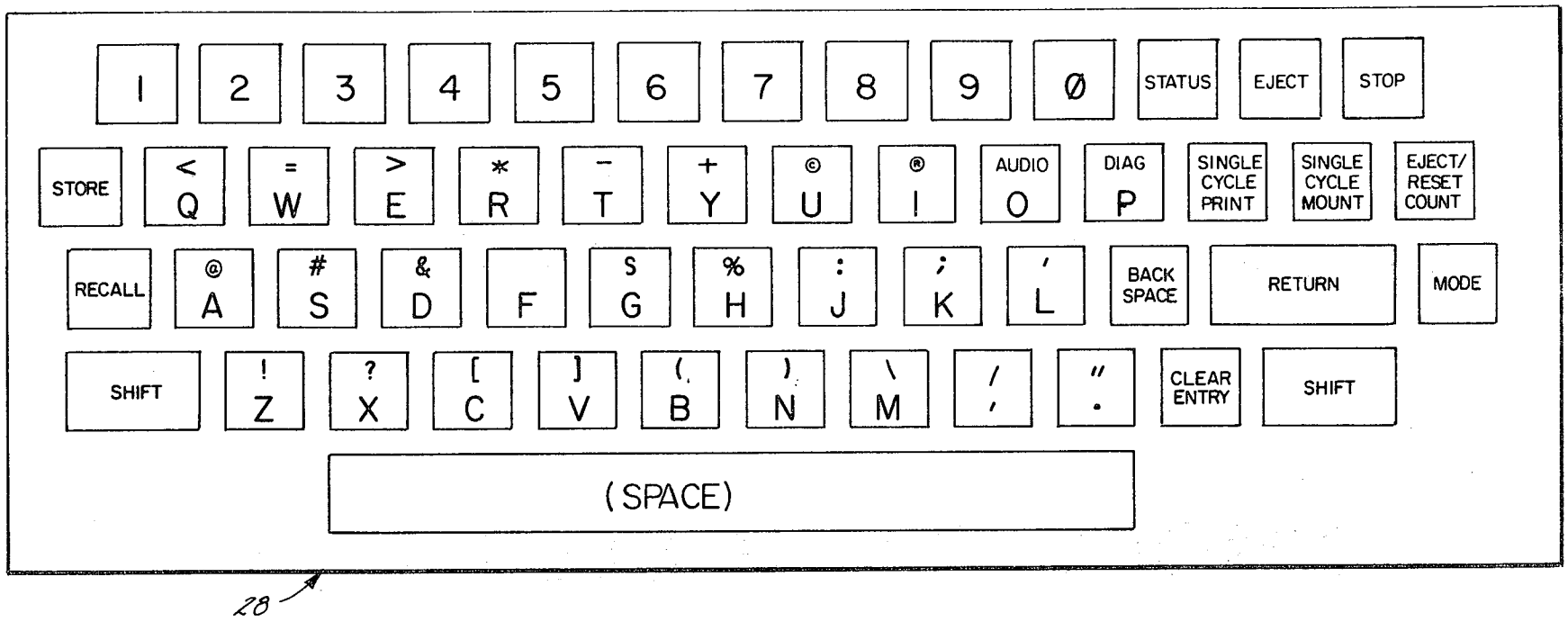
FIG. 9 is a plan view of the keyboard of the control console of the data printing apparatus of FIG. 1.

All operator controls of data printer 12 except foot switch 222 and eject switch 224 are contained on keyboard 28 of control console 14. FIG. 9 shows keyboard 28, which is preferably a 53-key membrane switch keyboard. Microprocessor 200 detects a key closure on keyboard 28 through display keyboard controller 212. As shown in FIG. 9, keyboard 28 includes both upper and lower case keys. Upper case keys must be preceeded by pressing of the SHIFT key.

4. Function of Operator Controls

There are three classes of operator controls: "activity controls" which cause activity of mounter 10 and data printer 12, "condition controls" which select operating conditions, and "data entry controls" which are used in data entry. Only the activity controls directly relate to the present invention, and therefore only these controls will be discussed. A detailed description of the remainder of the controls and of the various operating modes of data printer 12 is contained in the previously mentioned application "Apparatus for Printing Alphanumeric Information on Photographic Slide Mounts", 1 Ser. No. 341,296, and is hereby incorporated by reference.

A. Activity Controls

The activity controls include foot switch 222, eject switch 224 and the STOP, SINGLE CYCLE PRINT, SINGLE CYCLE MOUNT, EJECT, and EJECT/RESET COUNT keys of keyboard 28.

Depressing foot switch 222 begins slide mounting and printing activities of mounter 10 and data printer 12. This allows mounter 10 and data printer 12 to operate automatically through a series of mounting and printing cycles until the STOP key is pressed, and error occurs (as sensed by the control circuitry), the terminal or final count has been reached in a slide numbering sequence, or foot switch 222 is released.

The STOP key stops the automatic mounting and printing operation of mounter 10 and data printer 12 at the end of the current cycle. The STOP key is also used to stop a diagnostic test when the control system is in a diagnostic mode.

The SINGLE CYCLE PRINT key allows the mounting and printing of one slide. Activation of this key allows the operator to examine a single mount before initiating fully automatic operation of mounter 10 and data printer 12.

The SINGLE CYCLE MOUNT key allows slide mounter 10 to advance one mount. No printing occurs, but film will be mounted in the single slide mount.

The EJECT key causes microprocessor 200 to actuate eject drive motor 66. The last two mounts in the slide track are driven out of data printer 12 and into collecting basket 26.

The EJECT/RESET COUNT key on keyboard 28 and the eject switch 224 on slide mounter 10 perform the same function. Actuating either eject switch 224 or the EJECT/RESET COUNT key not only results in eject motor 66 being actuated, but also causes microprocessor 200 to reset the slide and duplicate counts. This is normally done at the end of each order.

5. Conclusion

In conclusion, the data printing apparatus of the present invention provides reliable, highly flexible data printing of alphanumeric information on photographic slide mounts. The data printing apparatus of the present invention is compatible with a slide mounter using one-piece preclosed plastic slide mounts such as the Pakon slide mount. A wide variety of operating and diagnostic modes are provided.

Although the present invention has been described with reference to preferred embodiments, workers skilled in the art will recognize that changes may be made in form and detail without departing from the spirit and scope of the invention. For example, although the specific embodiment shown in FIGS. 2–7 uses timing belt 92 to drive carriage 80, other embodiments use a rack-and-pinion type of carriage drive.

What is claimed is:

1. Apparatus for printing alphanumeric information on photographic slide mounts, the apparatus comprising:

a generally horizontal slide track along which the photographic slide mounts are intermittently advanced, the slide track having an entrance end and an exit end and including a printing station between the entrance end and exit end;

a pair of generally parallel conveyor belts positioned above and adjacent opposite sides of the slide track, the conveyor belts extending from the printing station toward the exit end of the slide track so that the conveyor belts engage a top surface of a slide mount to hold the slide mount in position between the belts and the slide track for printing at the printing station;

a carriage track aligned in a plane parallel to and below a plane defined by the slide track and running in a generally transverse direction to the slide track;

a carriage movable on the carriage track below the slide track;

a print head carried by the carriage for printing alphanumeric characters on a bottom side of a slide mount when the slide mount is positioned in the slide track at the printing station;

platen means positioned above the slide track and between the conveyor belts at the printing station for engaging the top surface of the slide mount when the print head is printing on the bottom surface of the slide mount;

carriage drive means for moving the carriage on the carriage track; and control means for controlling the print head and the carriage drive means to print selected alphanumeric information on the slide mount positioned at the printing station.

2. The apparatus of claim 1 wherein the slide track has a film insertion station between the entrance end and the printing station, the apparatus further comprising:

film insertion means for causing a photographic film transparency to be at least partially inserted into the slide mount at the film insertion station; and mount indexing means for causing the slide mount to be indexed from station-to-station along the slide track.

3. The apparatus of claim 2 and further comprising:

magazine means adjacent the entrance end of the slide track for holding a stack of empty slide mounts; and slide mount collecting means adjacent the exit end of the slide track for receiving the slide mounts as they leave the exit end of the slide track.

4. The apparatus of claim 3 and further comprising:

means for providing an eject signal indicating that a final slide mount of a customer order is at the printing station; and eject motor means responsive to the eject signal and connected to the conveyor belts for driving slide mounts located between the printing station and the exit end into the slide mount collecting means.

5. The apparatus of claim 4 wherein the control means includes means for maintaining a count of slide mounts printed, and wherein the means for maintaining a count resets the count in response to the eject signal.

6. The apparatus of claim 3 wherein the film insertion station is adjacent the entrance end, the printing station is adjacent the film insertion station, and a mount holding station is positioned between the printing station and the exit end.

7. The apparatus of claim 6 wherein the mount indexing means, during each operating cycle of the apparatus, pushes a lowermost slide mount out of the magazine and into the slide track to the film insertion station, thereby pushing slide mounts in the slide track to the succeeding stations.

8. The apparatus of claim 1 and further comprising:

a pair of guide rails on opposite sides of the slide track at the printing station for guiding longitudinal edges of the slide mounts.

9. The apparatus of claim 8 and further comprising:

platen support means attached to the pair of guide rails for supporting the platen means in spaced relationship above the slide track.

10. The apparatus of claim 9 wherein the platen support means includes a cross brace extending between the pair of guide rails and an adjustable vertical support attached at its lower end to the platen means and adjustably connected at its upper end to the cross brace.

11. Apparatus for printing alphanumeric information on photographic slide mounts, the apparatus comprising:

a horizontal platform having a printing aperture therein at a printing station;

a pair of horizontal parallel guides attached to the platform defining a slide track;

a horizontal carriage track positioned below the platform and running in a generally transverse direction to the slide track;

a carriage movable in the carriage track;

a print head carried by the carriage for printing alphanumeric characters through the printing aperture onto a bottom surface of a slide mount positioned at the printing station; and platen means positioned above the printing aperture at the printing station for engaging a top surface of the slide mount to limit upward deflection of the slide mount when the print head is printing on the bottom surface of the slide mount.

12. The apparatus of claim 11 and further comprising:

platen support means attached to the pair of guides for supporting the platen means in spaced relationship above the platform.

13. The apparatus of claim 12 wherein the platen support means includes a cross brace extending between the pair of guides and an adjustable vertical support attached at its lower end to the platen means and adjustably connected at its upper end to the cross brace.

14. The apparatus of claim 13 wherein the slide track has an entrance end and an exit end and has a film insertion station between the entrance end and the printing station, the apparatus further comprising:

film insertion means for causing a photographic film transparency to be at least partially inserted into the slide mount at the film insertion station; and mount indexing means for causing the slide mount to be indexed from station-to-station along the slide track.

15. The apparatus of claim 11 and further comprising:

a pair of generally parallel conveyor belts adjacent opposite sides of the slide track and positioned above the platform so that a slide mount at the print station is held between lower runs of the belts and the platform;

means for providing an eject signal indicating that a final slide mount of a customer order is at the printing station; and eject motor means responsive to the eject signal and connected to the conveyor belts for driving a slide mount out of the printing station.

16. The apparatus of claim 15 and further comprising:

magazine means adjacent the entrance end of the slide track for holding a stack of empty slide mounts; and slide mount collecting means adjacent the exit end of the slide track for receiving the slide mounts as they leave the exit end of the slide track.

17. The apparatus of claim 16 wherein the film insertion station is adjacent the entrance end, the printing station is adjacent the film insertion station, and a mount holding station is positioned between the printing station and the exit end.

18. The apparatus of claim 17 wherein the mount indexing means, during each operating cycle of the apparatus, pushes a lowermost slide mount out of the magazine and into the slide track to the film insertion station, thereby pushing slide mounts in the slide track to the succeeding stations.

19. Apparatus for printing alphanumeric information on photographic slide mounts, the apparatus comprising:

a slide track along which the photographic slide mounts are advanced, the slide track including a printing station and an exit end;

printer means for printing alphanumeric characters on a slide mount when the slide mount is positioned in the slide track at the printing station;

mount indexing means for causing the slide mount to be indexed from station-to-station along the slide track;

a pair of generally parallel conveyor belts adjacent opposite sides of the slide track and extending from the printing station toward the exit end so that a slide mount at the print station is held between the belts and the slide track;

means for providing an eject signal indicating that a final slide mount of a customer order is at the printing station;

eject motor means responsive to the eject signal and connected to the conveyor belts for driving the conveyor belts to cause the slide mount located at the printing station to be driven toward the exit end; and control means for controlling the printer means and the mount indexing means.

20. The apparatus of claim 19 and further comprising:

means for maintaining a count of slide mounts printed, and wherein the count is reset in response to the eject signal.

* * * * *